US006366011B1

(12) United States Patent
Komiya et al.

(10) Patent No.: US 6,366,011 B1
(45) **Date of Patent: *Apr. 2, 2002**

(54) ELECTRON GUN FOR CATHODE-RAY TUBE FOR IMAGE DISPLAY HAVING AN ELECTRODE WITH REDUCED ELECTRON BEAM PASSAGE HOLE AND A CATHODE WITH AN ELECTRON EMISSIVE LAYER MAINLY MADE OF AN OXIDE OF AN ALKALINE EARTH METAL AND CONTAINING AN OXIDE OF A RARE EARTH METAL

(75) Inventors: Toshifumi Komiya; Sachio Koizumi, both of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/604,121

(22) Filed: Jun. 26, 2000

Related U.S. Application Data

(63) Continuation of application No. 09/021,995, filed on Feb. 11, 1998, now Pat. No. 6,124,667.

(30) Foreign Application Priority Data

Apr. 30, 1997 (JP) ..... 9-112312

(51) Int. Cl.[7] ..... H01J 29/46
(52) U.S. Cl. ..... 313/441; 313/346 R; 313/447
(58) Field of Search ..... 313/346 R, 346 DC, 313/337, 441, 411, 447, 446

(56) References Cited

U.S. PATENT DOCUMENTS

| | | | | |
|---|---|---|---|---|
| 4,682,077 A | | 7/1987 | Maruyama et al. | |
| 5,216,320 A | | 6/1993 | Koizumi et al. | |
| 5,808,404 A | | 9/1998 | Koizumi et al. | |
| 6,114,803 A | * | 9/2000 | Hosotani et al. | 313/461 |

* cited by examiner

*Primary Examiner*—Michael H. Day
*Assistant Examiner*—Joseph Williams
(74) *Attorney, Agent, or Firm*—Antonelli, Terry, Stout & Kraus, LLP

(57) ABSTRACT

An electron gun for a cathode-ray tube for image display including a cathode having a sleeve made of a refractory metal, a support provided at one end of the sleeve and made of a refractory metal containing a reducing element, a heater arranged in a space defined by the sleeve and the support, and an electron emissive material layer for emission of electrons. The electron emissive material layer is mainly made of an oxide of an alkaline earth metal and contains an oxide of a rare earth metal. The electron emissive material layer is prepared by forming a first layer on the support by spraying, and forming a second layer on the first layer by spraying. A dispersion amount of an oxide of a rare earth metal in the second layer is larger than that in the first layer and a first grid electrode is provided adjacent the cathode. The grid electrode has an electron beam passage hole for the electrons from the electron emissive material layer, and the electron beam passage hole has a diameter which is less than 0.4 mm.

20 Claims, 6 Drawing Sheets

22 : DISPERSION DENSITY 0.8wt%
23 : DISPERSION DENSITY 1.6wt%
24 : DISPERSION DENSITY 3.0wt%

ELECTRON GUN FOR CATHODE-RAY TUBE FOR IMAGE DISPLAY HAVING AN ELECTRODE WITH REDUCED ELECTRON BEAM PASSAGE HOLE AND A CATHODE WITH AN ELECTRON EMISSIVE LAYER MAINLY MADE OF AN OXIDE OF AN ALKALINE EARTH METAL AND CONTAINING AN OXIDE OF A RARE EARTH METAL

CROSS REFERENCE TO RELATED APPLICATION

This is a continuation of U.S. application Ser. No. 09/021,995, filed Feb. 11, 1998, now U.S. Pat. No. 6,124,667, the subject matter of which is incorporated by reference herein.

BACKGROUND OF THE INVENTION

The invention relates to a cathode-ray tube and, more particularly, to a cathode-ray tube having an electron gun with a cathode of a high current density in which stable electron emission characteristics are obtained for a long time.

Various cathode-ray tubes such as television picture tubes and image display electron tubes used as monitor tubes of information processing terminals have an electron gun for emitting one or a plurality of electron beams at one end of a vacuum envelope and a phosphor screen obtained by coating a fluorescent material film of one or a plurality of colors onto an inner surface at the other end of the vacuum envelope so that an electron beam emitted from the electron gun is two-dimensionally scanned by a magnetic field generated by a deflecting yoke attached to the outside of the vacuum envelope, thereby displaying a desired image.

For such a kind of recent cathode-ray tube, high definition of a display image is required in association with realization of a variety of display information, a high-density of display information. and the like. To realize high definition of a display image, it is necessary to remarkably improve focusing characteristics of the electron beam.

As means for improving the focusing characteristics to satisfy the requirement of the high definition mentioned above, it is considered to reduce an electron beam passage hole of a first grid electrode of the electron gun.

However, there arise a limitation on the reduction of the dimension of the diameter of the electron beam passage hole of the first grid electrode due to a limitation on a cut-off voltage, a limitation of an electrode manufacturing precision, and a limitation of a cathode loading. Particularly, the cathode loading relates to the life reliability of the cathode-ray tube and exerts a large influence in case of deciding the hole diameter of the first grid electrode.

Therefore, the reduction of the hole diameter of the first grid electrode is limited to no less than 0.40 mm except for a combined use of an impregnated cathode suitable for a high current density operation. The impregnated cathode, however, has problems such that the number of manufacturing steps is large and it is expensive.

A cathode-ray tube having a cathode with an electron emissive material layer to solve such problems has been disclosed in U.S. Pat. No. 5,216,320 issued Jun. 1, 1993, and assigned to the same assignee as that of the present invention. FIG. 1 is a cross sectional view for explaining a structure similar to that of a cathode shown in the above U.S. patent. Reference numeral 13 denotes a cylindrical cathode sleeve; 14 a cap-shaped metal base; 15 an electron emissive material layer; 16 a heater; 19 a first layer made of an oxide of alkaline earth metal; and 20 a second layer made of an oxide of alkaline earth metal containing a rare earth metal (for example, barium scandate $Ba_2Sc_2O_5$).

The cap-shaped metal base 14, sealing one end of the cylindrical cathode sleeve 13, is made of a material made of refractory metal, for example, nickel (Ni) as a main component and containing therein a reduction metal of a small quantity of silicon (Si) or magnesium (Mg). The heater 16 is placed in the cathode sleeve 13, thereby constructing an indirectly heated cathode.

The electron emissive material layer 15 having a double layer structure is coated or formed on the upper surface of the metal base 14. The electron emissive material layer 15 includes the first layer 19 made of an oxide of alkaline earth metal coated or formed so as to be in contact with the upper surface of the metal base 14 and the second layer 20 made of an oxide of alkaline earth metal which is coated or formed on the surface of the first layer 19 and contains an oxide of rare earth metal such as barium scandate or the like.

The electron emissive material layer 15 with the above structure may be manufactured as follows. A first layer of a carbonate of alkaline earth metal is first formed on the upper surface of the metal base 14. A second layer of a carbonate of alkaline earth metal containing an oxide of rare earth metal such as barium scandate ($Ba_2SC_2O_5$) or the like is formed on the first layer. After that, the carbonate of alkaline earth metal of each of the first and second layers is changed to an oxide of alkaline earth metal by a thermal decomposition at the time of a heat treatment in a manufacturing step of the cathode-ray tube, thereby obtaining the electron emissive material layer 15 comprising the first layer 19 and the second layer 20 laminated on the first layer 19.

According to the structure of the electron emissive material layer 15 as mentioned above, the second layer 20 made of the oxide of alkaline earth metal formed on the electron emissive surface side of the electron emissive material layer 15 and containing the oxide of rare earth metal such as barium scandate or the like binds free barium (Ba) formed by a reduction element in the metal substance 14 to the second layer 20 and maintains free barium in the electron emissive material layer 15 so as to be in a high density state.

Thus, even when the cathode operates in a high current density state, an amount of Joule heat generated in the electron emissive material layer 15 is reduced and a degree of evaporation of barium also decreases.

As mentioned above, even when the cathode shown in FIG. 1 is operated-in a high density current state, for example, in a large current state exceeding $2A/cm^2$, the reduction of current emission is small and the cathode of a long life can be realized.

SUMMARY OF THE INVENTION

In order to display an image on a display panel at high definition, it is necessary to reduce a diameter of an electron beam passage hole of an electrode, namely, a first grid electrode which is arranged adjacent to the cathode and has a hole to limit emanation of electrons emitted from the cathode.

According to the knowledge derived by experiments and study of the present inventors, an oxide of rare earth metal such as barium scandate or the like has functions of binding free barium and maintaining free barium in an electron emissive material layer in a high density state. However, since the rare earth metal oxide itself such as barium scandate or the like never contributes to the electron emission, when a content of the rare earth metal oxide such as barium scandate or the like in the electron emissive material layer is increased, an amount of emission of electrons from the electron emissive material layer decreases and the life of the cathode-ray tube is not always extended.

In addition, the rare earth metal oxide such as barium scandate or the like is an expensive material.

It is an object of the invention to provide a cathode-ray tube which is capable of displaying an image at high definition (high resolution) and has a sufficiently long operating life.

Another object of the invention is to provide an electron gun suitable for the above cathode-ray tube.

According to one aspect of the invention, there is provided a cathode-ray tube with an electron gun having a cathode, a control electrode, and another electrode, wherein the cathode has an electron emissive material layer for emanating electrons through a hole of the control electrode, the hole in the control electrode substantially having a diameter in a range from 0.3 mm to 0.4 mm, and the electron emissive material layer includes a first layer which is formed on a support and is made of an oxide of alkaline earth metal containing no oxide of rear earth metal and includes a second layer which is formed on the first layer and is mainly made of an oxide of alkaline earth metal substantially containing an oxide of rare earth metal of a quantity in a range from 0.8 wt % to 5.0 wt %.

As a diameter of electron beam passage hole formed on a first grid electrode (a control electrode arranged adjacent to the cathode) is smaller, a beam diameter at a crossover point in the electron gun more decreases and focusing characteristics are more improved. In case of a color cathode-ray tube, however, in addition to a cathode loading, a variation (dissidence) of cut-off voltages among three electron beams (R beam, G beam, B beam) occurs, and due to a limitation of manufacturing precision, there arises a limitation on the reduction of the hole diameter of the electron beam passage hole.

For adjustment of the cut-off voltages to constant values, with the diameter of the electron beam passage hole of the first grid electrode being reduced, a distance between the cathode and the first grid electrode has to be reduced, which will result in a larger cut-off voltage fluctuation due to a variation in dimensions between the cathode and the first grid electrode.

FIG. 2 is a characteristics graph showing a change in variation of cut-off voltages among three beams, for a specific cut-off voltage, in the case where the hole diameter of the first grid electrode is reduced. An axis of ordinate indicates a ratio of the highest cut-off voltage to the lowest cut-off voltage.

According to the current electrode manufacturing technique, as shown in the diagram, when the diameter of the electron beam passage hole of the first grid electrode is less than 0.3 mm, the variation of the cut-off voltage is large and is intolerable for a practical use.

The effect of dispersion of the rare earth metal oxide, such as barium scandate or the like in the alkaline earth metal oxide of the cathode will be, unless its dispersion density exceeds a certain value, such that durability of the cathode against the cathode loading increases in accordance with an increase of the dispersion density, so that under the same condition, the life time (a time period in which a value in percentage of a ratio of an initial maximum anode current to a maximum anode current after a lapse of a time becomes 50%) is extended.

FIG. 3 is a characteristics diagram showing a transition of a ratio with respect to an initial maximum anode current for a diameter d of the electron beam passage hole of the first grid electrode being 0.40 mm in which cathode-ray tubes having electron guns using cathodes in which a dispersion amount of an oxide of rare earth metal such as barium scandate or the like in the oxide of alkaline earth metal is changed is operated under the same test conditions.

In the diagram, curves 22, 23, and 24 show cases where cathodes have dispersion densities equal to 0.8 wt %, 1.6 wt % and 3.0 wt %, respectively.

It will be also understood from this characteristics diagram that when the dispersion density of the rare earth metal oxide such as barium scandate or the like in the alkaline earth metal oxide is increased, a reduction in the ratio of a maximum anode current with respect to the initial maximum anode current becomes gentle and the durability against the cathode loading increases and the life time as a cathode-ray tube becomes long.

However, if it is intended to improve the focusing characteristics by further reducing the hole diameter of the electron beam passage hole of the first grid electrode in order to satisfy the recent requirement for realization of high definition of a display image. It may be considered better to further increase the dispersion amount of the rare earth metal oxide such as barium scandate or the like.

However, as mentioned above, since the rare earth metal oxide itself such as barium scandate or the like never contributes to the emission of electrons, the increase of dispersion amount contrarily results in a decrease in the amount of emission of electrons from the electron emissive material layer.

FIG. 4A is an explanatory diagram showing a change in initial electron emission capability of a cathode-ray tube having an electron gun using a cathode in which a dispersion amount of barium scandate in the alkaline earth metal oxide is changed. The initial electron emission capability is shown by normalizing it by an initial electron emission capability at 0 wt % dispersion amount. The diameter d of the electron beam passage hole of the first grid electrode of the electron gun is equal to 0.4 min.

FIG. 4B is an explanatory diagram of a life time of a cathode-ray tube having an electron gun using a cathode in which a dispersion amount of the rare earth metal oxide such as barium scandate or the like in the alkaline earth metal oxide is changed. The diameter d of the electron beam passage hole of the first grid electrode of the electron gun is equal to 0.35 mm.

As will be understood from FIGS. 4A and 4B, when the dispersion amount of barium scandate in the alkaline earth metal oxide is equal to or larger than 5%, the electron emission amount obviously decreases (FIG. 4A), and further, when the dispersion amount approaches the same dispersion amount 5% where the electron emission capability decreases to 90 to 95% as compared with the initial electron emission capability with the dispersion amount of 0 wt %, even if the dispersion amount is increased any more, the life time of the cathode-ray tube is saturated or decreases (FIG. 4B).

It has been found that the above tendency regarding FIGS. 4A and 4B occurs independent of the value of the diameter of the electron beam passage hole of the first grid electrode of the electron gun.

As mentioned above, when the content of the rare earth metal oxide such as barium scandate or the like is increased in order to improve the high density current operating characteristics, the electron emission amount of the cathode decreases and, further, the life as a cathode-ray tube becomes short. It is, therefore, necessary to decide the dispersion amount of the rare earth metal oxide in accordance with the using conditions (typically, the diameter of the electron beam passage hole of the first grid of the electron gun).

FIG. 5 is a characteristics diagram in which the relation between the cathode loading and the life time was obtained with respect to five kinds of cathodes in which the dispersion density of the rare earth metal oxide such as barium scandate or the like was changed. Reference characters A, B, C, D, and E show cases using cathodes in which the dispersion amounts of barium scandate are equal to 0 wt %, 0.8 wt %, 1 wt %, 3 wt % and 5 wt %, respectively.

The diagram shows that when the diameter of the electron beam passage hole of the first grid electrode is reduced for the same cathode current, the cathode loading ($A/cm^2$) becomes heavier and the life becomes shorter accordingly.

With the conventional cathode containing no rare earth metal oxide, when the diameter of the electron beam passage hole of the first grid electrode is lower than 0.40 mm (in the diagram, shown as $\phi$0.40, and the same shall also apply hereinbelow), the life time of the cathode will be so short that a cathode-ray tube with such conventional cathode is supposed to be unacceptable in the market and the cathode will need improvement. That is, considering the life characteristics of the cathode-ray tube, in the conventional oxide cathode containing no rare earth metal oxide, except for the combined use with the impregnated cathode suitable for the high current density operation, a limit value of the reduction of the diameter of the electron beam passage hole of the first grid electrode was 0.40 mm.

On the other hand, in order to satisfy the recent requirement of the high definition display image, as means for improving the focusing characteristics, it is necessary to set the hole diameter of the electron beam passage hole of the first grid electrode to a value smaller than 0.40 mm. As will be also understood from FIG. 2, however, in case of considering the current electrode manufacturing precision and the limitation of a variation in spot extinguishing voltage (cut-off voltage) of each cathode, the limit value of the reduction of the hole diameter of the electron beam passage hole of the first grid electrode is 0.30 mm. When the variation of the cut-off voltage increases to a value near 1.3, a load to a circuit to adjust each cathode voltage of the cathode-ray tube in the television or display monitor increases and it is not practical in the present market from a viewpoint of the costs.

Therefore, even if the diameter of the electron beam passage hole of the first grid electrode is less than 0.40 mm, by increasing the dispersion amount at least up to 0.8 wt % to a line B in FIG. 5) by allowing the rare earth metal oxide such as barium scandate or the like to be contained, the effect of improving the life characteristics can be sufficiently obtained. Moreover, when the dispersion amount is equal to 0.8 wt %, even if the diameter of the electron beam passage hole is equal to 0.30 mm, life characteristics which are almost equivalent to those in case of combining the conventional cathode containing no rare earth metal oxide and the first grid electrode in which the diameter of the electron beam passage hole is equal to 0.40 mm are obtained. Further, good life characteristics can be maximally effected at the dispersion density of 3.0 wt % (refer to a line D in FIG. 5) in a range where-there is no change in initial electron emitting characteristics.

More preferably, when the diameter of the electron beam passage hole is equal to 0.30 mm, in order to obtain a life time that is almost equal to that in case of combining the conventional cathode containing no rare earth metal oxide and the first grid electrode in which the diameter of the electron beam passage hole is equal to 0.40 mm, the dispersion amount should be increased to about 1.0 wt %. When the dispersion amount is equal to 0.8 wt %, in order to obtain a life time that is almost equal to that in case of combining the conventional cathode containing no rare earth metal oxide and the first grid electrode in which the diameter of the electron beam passage hole is equal to 0.40 mm, the diameter of the electron beam passage hole should be about 0.33 mm.

In the above dispersion, as an oxide of rare earth metal to be contained in the oxide of alkaline earth metal serving as an electron emissive material layer, use of a europium oxide ($Eu_2O_3$), a scandium oxide ($Sc_2O_3$), or an yttrium oxide ($Y_2O_3$) in place of barium scandate ($Ba_2Sc_2O_5$, $BaSc_2O_4$, or $Ba_3ScO_9$) offers a similar effect.

As mentioned above, by selecting the dispersion amount of the rare earth metal oxide such as barium scandate or the like in the alkaline earth metal oxide in accordance with the using conditions of the cathode, the electron gun having excellent high current density operating characteristics and satisfactory electron emitting characteristics can be obtained at relatively low cost.

DESCRIPTION OF THE PREFERRED EMBODIMENT

Embodiments of the invention will now be described in detail hereinbelow.

Figure 1:
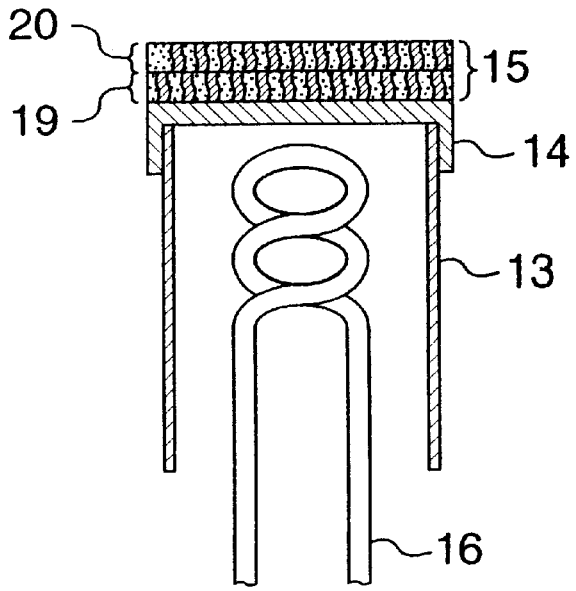
FIG. 1 PRIOR ART
FIG. 1 is a cross-sectional view for explaining a structure of a conventional cathode.
Figure 2:
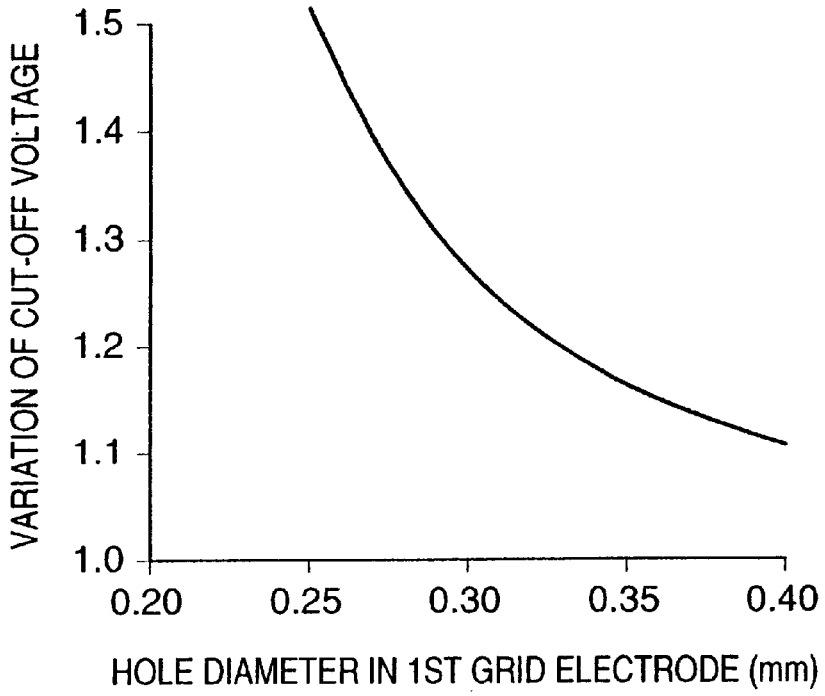
FIG. 2 is a characteristics diagram showing a change in variation of a cut-off voltage, for a specific cut-off voltage, in case of reducing a hole diameter of a first grid electrode and is based on data derived by experiments of the present inventors.
Figure 3:
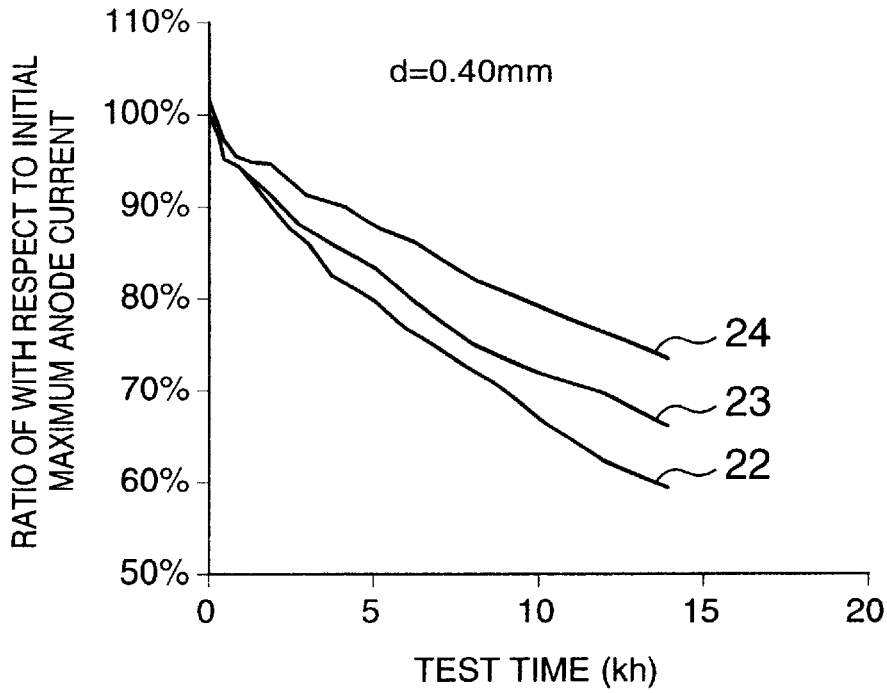
FIG. 3 is a characteristics diagram showing a transition of a ratio with respect to the initial maximum anode current when a cathode-ray tube having an electron gun using a cathode in which a dispersion amount of a rare earth metal oxide such as barium scandate or the like in an alkaline earth metal oxide is changed is operated under the same test conditions and is based on the data derived by the experiments of the present inventors.
Figure 5:
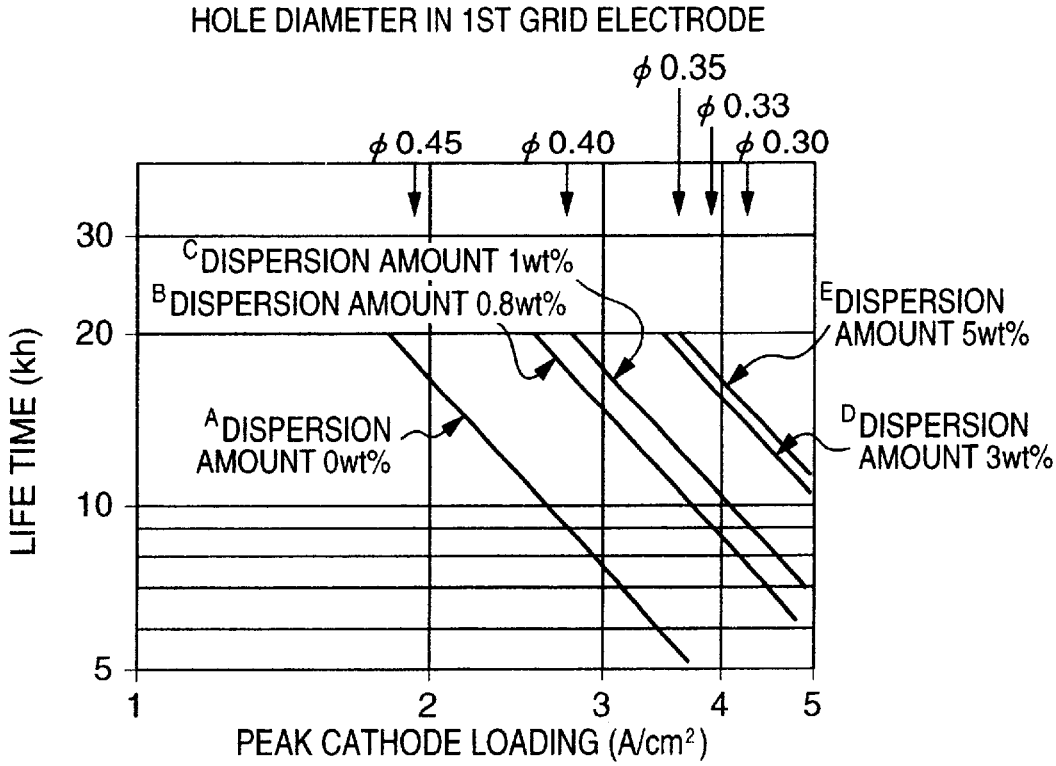
FIG. 5 is a characteristics diagram in which the relation between the cathode loading and the life time is obtained with respect to three kinds of cathodes in which dispersion amounts are changed, and is based on the data derived by the experiments of the present inventors.
Figure 4A:
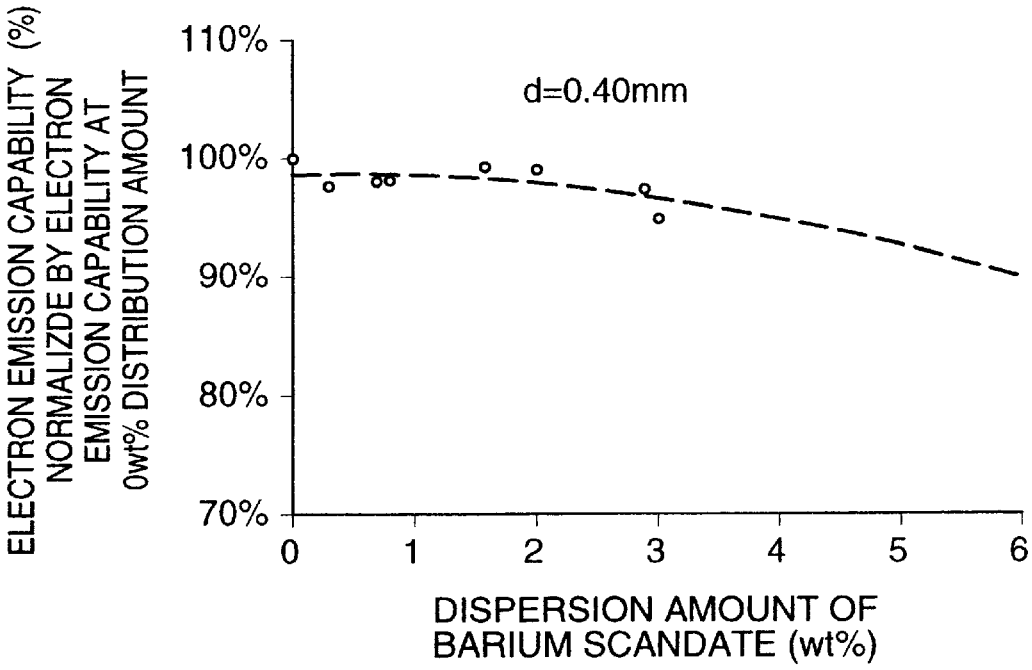
FIG. 4A is an explanatory diagram of a difference of an initial electron emission capability of the cathode-ray tube having an electron gun using a cathode in which a dispersion amount of the rare earth metal oxide such as barium scandate or the like in the alkaline earth metal oxide is changed and is based on the data derived by the experiments of the present inventors.
Figure 4B:
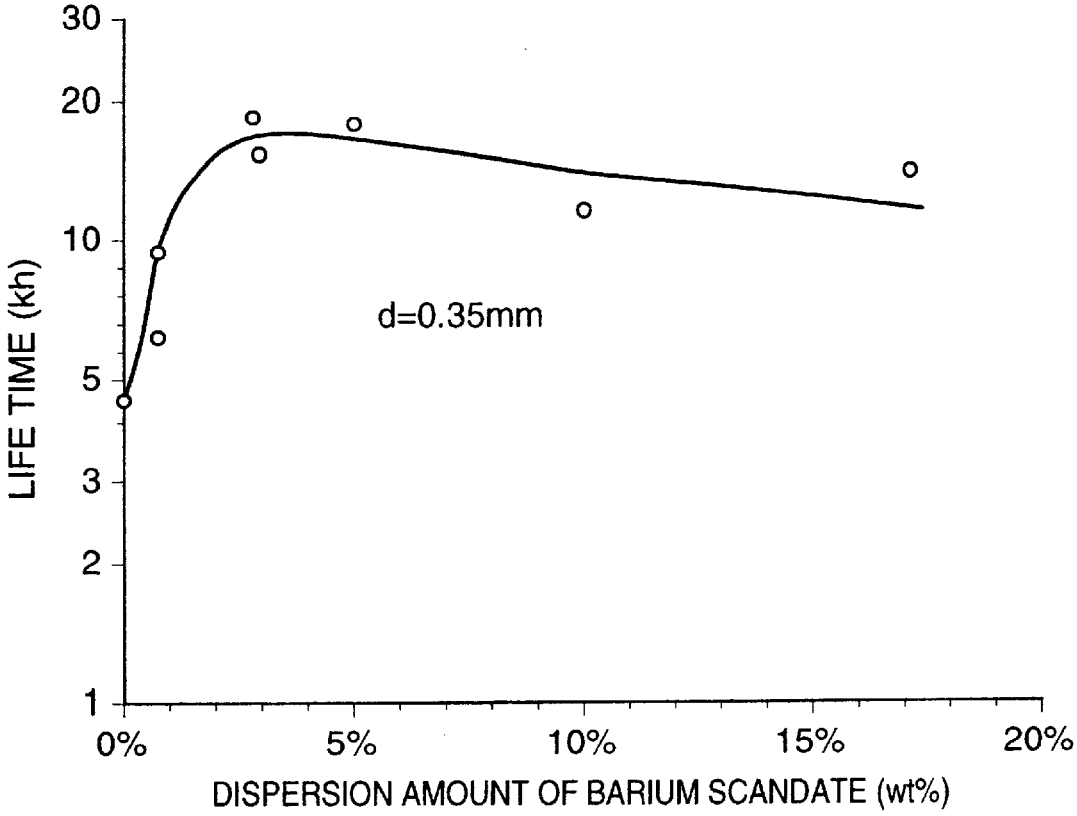
FIG. 4B is a diagram showing a life of the cathode-ray tube having an electron gun using a cathode in which a distribution amount of the rare earth metal oxide such as barium scandate or the like in the alkaline earth metal oxide is changed and is based on the data derived by the experiments of the present inventors.
Figure 6:
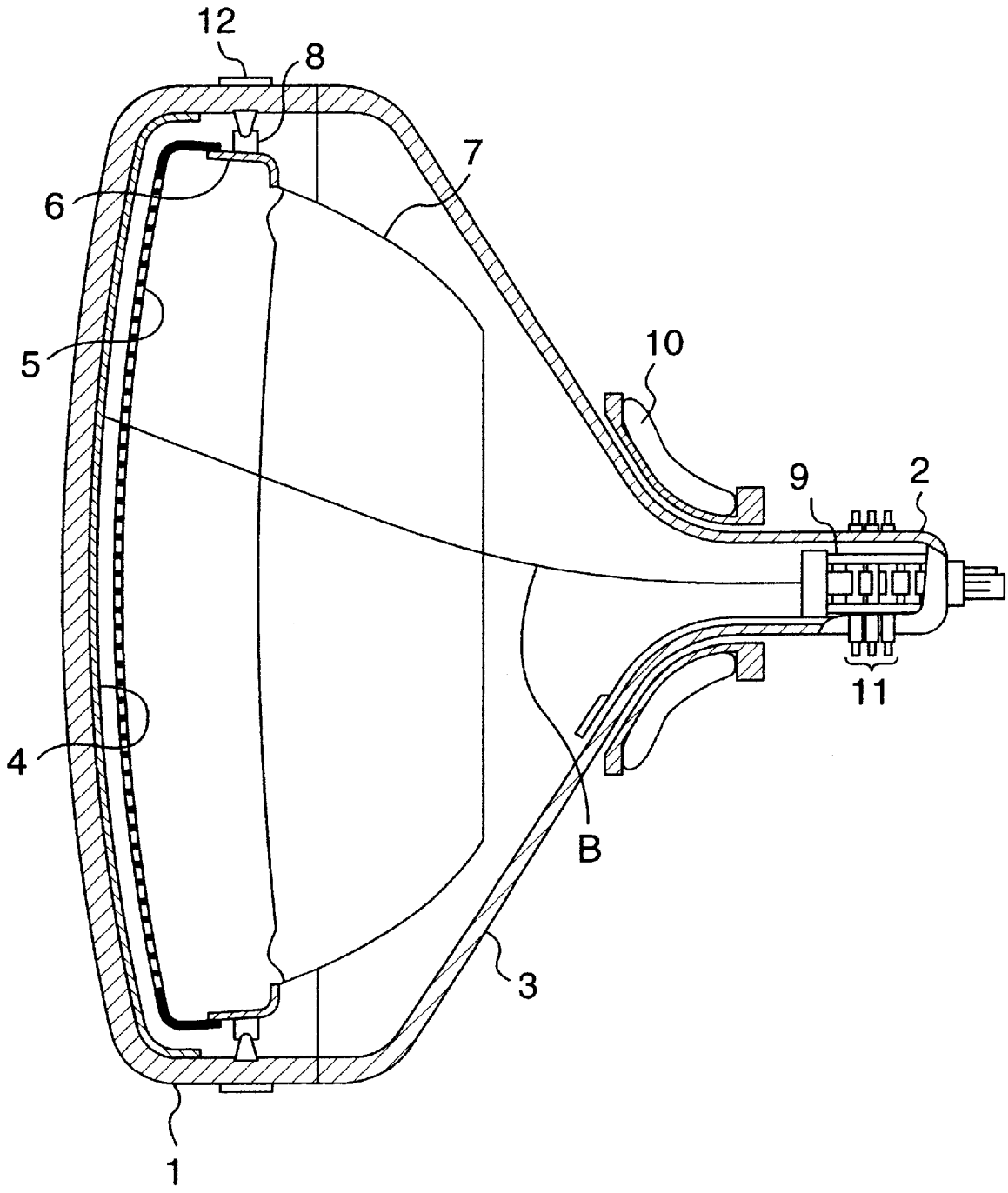
FIG. 6 is a cross sectional view of a schematic structure of a color cathode-ray tube as an example of a cathode-ray tube to which the invention may be applied.

FIG. 6 is a cross-sectional view for explaining a schematic structure of a color cathode-ray tube as an embodiment of a cathode-ray tube having an electron gun using a cathode having an electron emissive material layer according to the invention. Reference numeral 1 denotes a panel portion; 2 a neck portion; 3 a funnel portion; 4 a fluorescent film; 5 a shadow mask; 6 a mask frame; 7 a magnetic shield; 8 a mask suspending mechanism; 9 an electron gun; 10 a deflecting yoke; 11 a magnet for adjusting a color purity and a static convergence; and 12 reinforcing hardware.

A vacuum envelope forming a color cathode-ray tube includes a front panel portion 1, elongated neck portion 2 enclosing the electron gun 9 and conical funnel portion 3 for coupling the panel portion and the neck portion.

The fluorescent film 4 is coated and formed on the inner surface of the panel portion 1. The shadow mask 5 is suspended and fixed to the mask suspending mechanism 8 by the mask frame 6 so as to face the fluorescent film 4.

The magnetic shield 7 is arranged in a portion near the coupling portion of the panel portion 1 and funnel portion 3. The deflecting yoke 10 is attached to the outside of the transition region of the funnel portion 3 and neck portion 2. The magnet 11 for adjusting the color purity and static convergence is arranged on the outer periphery of the neck portion.

In the color cathode-ray tube with the above structure, three electron beams B (one electron beam is shown in the diagram) emitted from the electron gun 9 are two-dimensionally deflected by the horizontal and vertical magnetic fields generated by the deflecting yoke 10. After that, the electron beams reach color pixels corresponding to the fluorescent film 4 through a number of openings formed in the shadow mask 5 and allow the fluorescent film 4 to emit light, thereby forming a desired image.

Since the image display operation of the color cathode-ray tube with the above structure is similar to that of the well-known color cathode-ray tube, further description will be omitted.

Figure 7:
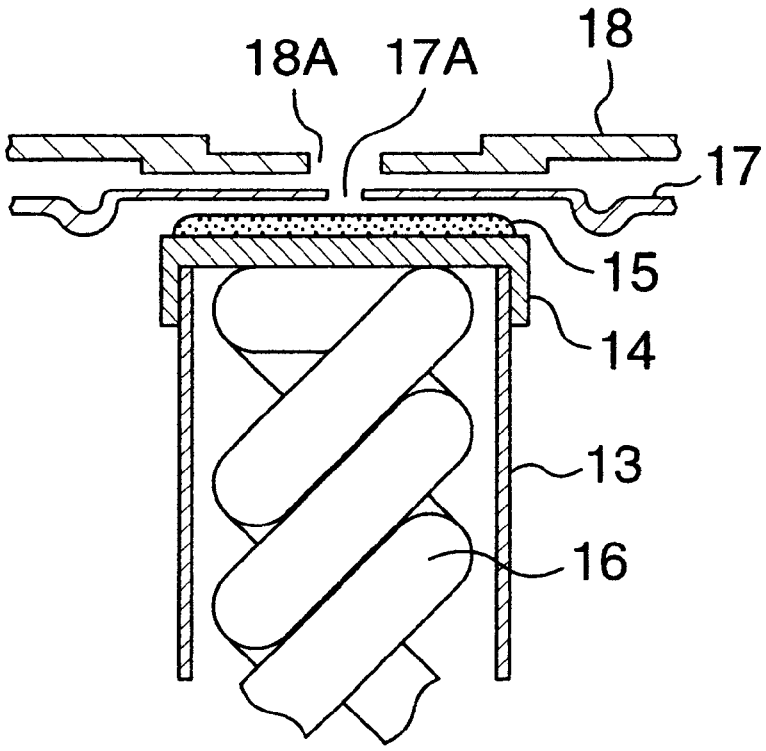
FIG. 7 is an enlarged cross sectional view of a cathode and member associated therewith which can be enclosed in the color cathode-ray tube shown in FIG. 6 and form an electron gun according to an embodiment of the invention.

FIG. 7 is an enlarged cross sectional view of the cathode constituting the electron gun enclosed in the color cathode-ray tube shown in FIG. 6. Reference numeral 13 denotes the cylindrical metal sleeve; 14 the cap-shaped metal substance; 15 the electron emissive material layer; 16 the heater; 17 a first grid electrode; 17A an electron beam passage hole of the first grid electrode; 18 a second grid electrode; and 18A an electron beam passage hole of the second grid electrode.

The first grid electrode 17 and second grid electrode 18 are formed by press-molding metal plates of stainless or nickel iron alloy and the electron beam passage holes 17A and 18A are formed in the metal plate.

A diameter of the electron beam passage hole 17A of the first grid electrode 17 is equal to 0.35 mm. A diameter of the electron beam passage hole 18A of the second grid electrode 18 is equal to 0.42 mm.

The cathode sleeve 13 and metal substance 14 are thermally coupled to the heater 16 and are made of a metal material using a refractory metal, for example, nickel (Ni) as a main component and containing therein a small amount of reduction metal of silicon (Si) or magnesium (Mg). The cap-shaped metal base 14 is fitted so as to seal one end of the cathode sleeve 13 and the heater 16 is enclosed in the cathode sleeve 13, thereby constructing an indirectly heated cathode. The metal base 14 supports the electron emissive material layer 15 formed thereon.

Figure 8:
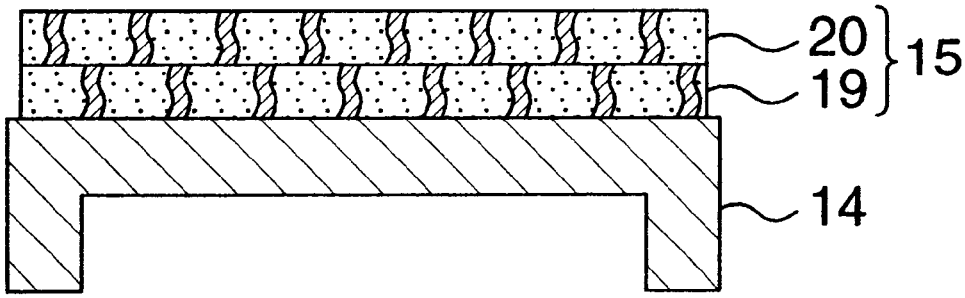
FIG. 8 is an explanatory diagram of an example of a detailed structure of an electron emissive material layer of the cathode shown in FIG. 7.

FIG. 8 is an explanatory diagram of a detailed structure of the electron emissive material layer portion of the cathode shown in FIG. 7.

The electron emissive material layer 15 is coated and formed on the upper surface of the cap-shaped metal base (support) 14 and has a double structure including the first layer 19 made of an oxide of alkaline earth metal and the second layer 20 made of an oxide of alkaline earth metal containing an oxide of rare earth metal such as barium scandate or the like.

In the electron emissive material layer 15 of the embodiment, the first layer 19 made of the alkaline earth metal oxide is made of a carbonate [(Ba.Sr.Ca) $CO_3$] of barium, strontium and calcium or the like. The second layer 20 made of an oxide of alkaline earth metal containing an oxide of rare earth metal is made of a carbonate [(Ba.Sr.Ca) $CO_3$] of barium, strontium and calcium, barium scandate ($Ba_2Sc_2O_5$), and the like.

A process of forming the first layer 19 made of the alkaline earth metal oxide and the second layer 20 made of the alkaline earth metal oxide containing the rare earth metal oxide will now be described.

First, the first layer 19 made of the alkaline earth metal oxide is formed as follows. A sodium carbonate ($Na_2CO_3$) is added to a mixture solution of 54 wt % of barium nitrate ($BaNO_3$), 39 wt % of strontium nitrate ($SrNO_3$), and 7 wt % of calcium nitrate ($CaNO_3$), and a carbonate [(Ba.Sr.Ca) $CO_3$] Of barium, strontium and calcium is precipitated. Nitrocellulose lacquer and butyl acetate are added to those precipitates (powder) and are rolling mixed, thereby adjusting a first suspension.

The second layer made of the alkaline earth metal oxide containing the rare earth metal oxide is formed as follows. A sodium carbonate ($Na_2CO_3$) is added to a mixture solution of 53 wt % of barium nitrate ($BaNO_3$), 38 wt % of strontium nitrate ($SrNo_3$), and 6 wt % of calcium nitrate ($CaNO_3$) of 6 wt %, and a carbonate [(Ba.Sr.Ca) $CO_3$] of barium, strontium and calcium is precipitated. 3 wt % of barium scandate ($Ba_2Sc_2O_5$) is mixed to those precipitates (powder). Nitrocellulose lacquer and butyl acetate are added to the mixture and are rolling mixed and a second suspension is adjusted.

Subsequently, the first suspension is coated onto the upper surface of the cap-shaped metal base 14 made of nickel (Ni) as a main component by a spray method, thereby forming the first layer 19 having a thickness of about 20 $\mu$m. The second suspension is coated onto the first layer 19 by a similar spray method, thereby forming the second layer 20 having a thickness of about 50 $\mu$m and forming the electron emissive material layer 15 of the double structure.

Subsequently, a cathode is positioned at a predetermined distance with respect to electrodes which are insulatively held by bead glasses, thereby welding and fixing to a cathode support provided for the bead glasses.

As for the cathode, in a vacuum evacuating step for the cathode-ray tube, the electron emissive material layer 15 is heated by the heater 16 and a carbonate [(Ba.Sr.Ca)$CO_3$] of barium, strontium and calcium is decomposed in the electron emissive material layer, thereby forming an oxide [(Ba.Sr.Ca)O] of barium, strontium and calcium. After that, by heating and activating under the atmosphere of 900 to 1100° C., a cathode is formed. By simultaneously supplying currents to the first and second grid electrodes, the gas is exhausted and the emission of electrons is stabilized.

The cathode of the stable characteristics can be formed as mentioned above.

According to the cathode having the electron emissive material layer 15 with the above structure, in the second layer 20 made of the alkaline earth metal oxide containing the rare earth metal oxide such as barium scandate or the like, free barium is held in the high concentration state by the binding function of free barium (Ba) by the rare earth metal oxide and can be maintained in a high concentration state of free barium in the electron emissive material layer 15.

Since the rare earth metal oxide is a substance which never emits electrons, it may degrade the electron emission. However, by specifying the dispersion amount (to 0.8 wt % to 5.0 wt %), a cathode enjoying high current density operating characteristics and large electron emitting characteristics which are necessary due to the reduction of the diameter of the electron beam passage hole of the first grid electrode is obtained. The focusing performance in the life characteristics similar to those of the conventional cathode can be improved.

In the above-described embodiment, as a second layer 20 made of the alkaline earth metal oxide containing the rare earth metal oxide, the rare earth metal oxide, for example, barium scandate ($Ba_2Sc_2O_5$) being a compound oxide of barium (Ba) and scandium (Sc) is contained in the amount of 3 wt %. In the invention, however, the content of barium scandate is not limited to 3 wt % but an arbitrary content can be selected so long as it lies within a range from 0.8 to 5.0 wt % as mentioned above. That is, when the content of rare earth metal oxide, for example, barium scandate contained in the second layer 20 is equal to or less than 0.8 wt %, the life improving effect when the diameter of the electron beam passage hole of the first grid electrode is equal to or less than 0.30 mm is insufficient. On the other hand, when the content of the rare earth metal oxide, for instance, barium scandate contained in the second layer 20 is equal to or larger than 5 wt %, the electron emitting function due to the containing of the rare earth metal oxide will be deteriorated.

Therefore, in the cathode according to the embodiment, a desirable content of the rare earth metal oxide, for example, barium scandate contained in the second layer 20 lies within a range from 0.8 to 5 wt %.

It will be obviously understood that the invention is not limited to the color cathode-ray tube in the embodiment shown in FIG. 6 but can be also similarly applied to a cathode of an electron gun constructing various cathode-ray tubes of other types.

Figure 9:
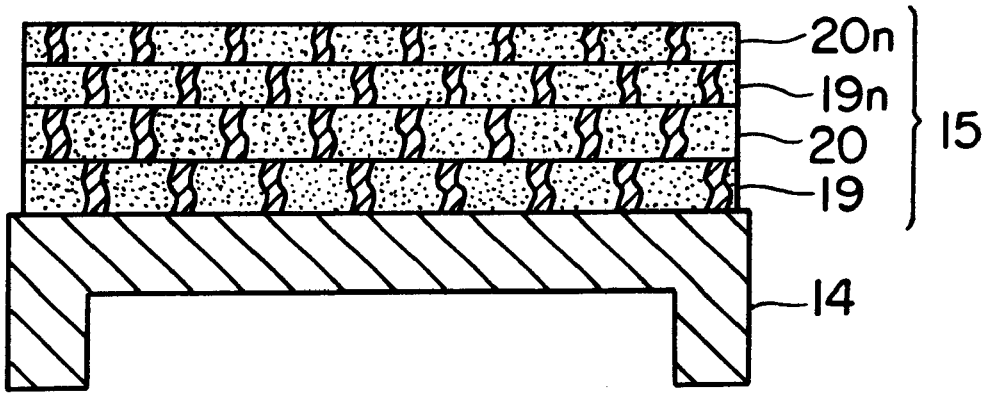
FIG. 9 is an explanatory diagram of another example of a detailed structure of an electron emissive material layer of the cathode shown in FIG. 7.

The electron emissive material layer 15 shown in FIG. 8 is not limited to the double layer structure but can also have a multilayer structure of three layers or more. That is, in FIG. 9 showing another example of a detailed structure of an electron emissive material layer of the cathode shown in FIG. 7, one or more layers 19*n* made of an alkaline earth metal oxide containing no rare earth metal oxide similar to the layer 19 and one or more layers 20*n* made of an alkaline earth metal oxide containing the rare earth metal oxide similar to the layer 20 are alternately formed on the layer 20. In the multilayer structure, for the layer 20 and all of the layers formed thereon taken in combination, the content of the rare earth metal oxide lies within a range from 0.8 wt % to 5.0 wt %, preferably, 1.0 wt % to 5.0 wt %.

As described above, according to the above embodiments, the alkaline earth metal oxide containing the rare earth metal oxide is used as an electron emissive material layer which is coated and formed on the upper surface of the metal base, free barium is held in a high concentration state, a free barium concentration in the electron emissive material layer is maintained in a high concentration state, and an emission amount of electrons from the electron emissive material layer is almost similar to that of the oxide cathode.

Thus, the cathode-ray tube in which the high current density operating characteristics and large electron emitting characteristics which are necessary due to the reduction of the diameter of the electron beam passage hole of the first grid electrode are simultaneously made the most of and excellent life characteristics are obtained and the focusing performance is improved can be derived.

What is claimed is:

1. An electron gun for a cathode-ray tube for image display comprising:

a cathode having a sleeve made of a refractory metal, a support provided at one end of said sleeve and made of a refractory metal containing a reducing element, a heater arranged in a space defined by said sleeve and said support, an electron emissive material layer for emission of electrons, said electron emissive material layer being mainly made of an oxide of an alkaline earth metal and containing an oxide of a rare earth metal, said electron emissive material layer being prepared by the steps of:

(a) forming a first layer on said support by spraying, and (b) forming a second layer on said first layer by spraying, wherein a dispersion amount of an oxide of a rare earth metal in said second layer is larger than that in said first layer; and a first grid electrode provided adjacent said cathode, said grid electrode having an electron beam passage hole for the electrons from said electron emissive material layer, said electron beam passage hole having a diameter which is less than 0.4 mm.

2. An electron gun according to claim 1, wherein said electron emissive material layer contains an oxide of a rare earth metal in an amount which is not less than 0.8 wt %.

3. An electron gun according to claim 2, wherein said electron emissive material layer contains an oxide of a rare earth metal in an amount which is not less than 1 wt %.

4. An electron gun according to claim 2, wherein said electron emissive material layer contains an oxide of a rare earth metal in an amount which is 0.8 wt % to 5.0 wt %.

5. An electron gun according to claim 3, wherein said electron emissive material layer contains an oxide of a rare earth metal in an amount which is 1 wt % to 5 wt %.

6. An electron gun according to claim 2, wherein said diameter of said electron beam passage hole in said first grid electrode is not less than 0.3 mm and less than 0.4 mm.

7. An electron gun according to claim 6, wherein said diameter of said electron beam passage hole in said first grid electrode is not less than 0.33 mm and less than 0.4 mm.

8. An electron gun according to claim 1, further comprising a second grid electrode provided adjacent said first grid electrode and opposite to said cathode with respect to said first grid electrode, said second grid electrode having an electron beam passage hole larger than said electron beam passage hole of said first grid electrode.

9. An electron gun according to claim 1, wherein said oxide of a rare earth metal contained in said electron emissive material layer is barium scandate, europium oxide or yttrium oxide.

10. An electron gun according to claim 9, wherein said oxide of a rare earth metal is barium scandate and said oxide of an alkaline earth metal is $(Ba.Sr.Ca)CO_3$.

11. A cathode-ray tube for image display comprising:

a fluorescent film formed on an inner surface of a panel portion and having fluorescent pixels of three colors; and an electron gun arranged in a neck portion and having a cathode, a first grid electrode and a second grid electrode to generate three electron beams, said cathode including:

(a) a sleeve for said cathode, said sleeve being made of a refractory metal, (b) a support provided at one end of said sleeve and made of a refractory metal containing a reducing element, (c) a heater arranged in a space delimited by said sleeve and said support, (d) an electron emissive material layer for emission of electrons, said electron emissive material layer being formed on said support and being mainly made of an oxide of an alkaline earth metal and containing an oxide of a rare earth metal in an amount which is not less than 0.8 wt %;

wherein said first grid electrode is adjacent said cathode and has an electron beam passage hole for the electrons from said electron emissive material layer, said electron beam passage hole having a diameter which is less than 0.4 mm, said electron beam passage hole having a diameter so that a variation among cut-off voltages of the three electron beams in terms of a ratio between a highest cut-off voltage and a lowest cut-off voltage for said first grid electrode is lower than 1.3.

12. A cathode-ray tube according to claim 11, wherein said ratio between a highest cut-off voltage and a lowest cut-off voltage for said first grid electrode is not higher than 1.27.

13. A cathode-ray tube according to claim 11, wherein said electron emissive material layer contains an oxide of a rare earth metal in an amount which is not less than 1 wt %.

14. A cathode-ray tube according to claim 13, wherein said electron emissive material layer contains an oxide of a rare earth metal in an amount which is 1 wt % to 5 wt %.

15. A cathode-ray tube according to claim 11, wherein said electron emissive material layer contains an oxide of a rare earth metal in an amount which is 0.8 wt % to 5.0 wt %.

16. A cathode-ray tube according to claim 11, wherein said diameter of said electron beam passage hole in said first grid electrode is not less than 0.3 mm and less than 0.4 mm.

17. A cathode-ray tube according to claim 16, wherein said diameter of said electron beam passage hole in said first grid electrode is not less than 0.33 mm and less than 0.4 mm.

18. A cathode-ray tube according to claim 11, further comprising a second grid electrode provided adjacent said first grid electrode and opposite to said cathode with respect to said first grid electrode, said second grid electrode having an electron beam passage hole larger than said electron beam passage hole of said first grid electrode.

19. A cathode-ray tube according to claim 11, wherein said oxide of a rare earth metal contained in said electron emissive material layer is barium scandate, europium oxide or yttrium oxide.

20. A cathode-ray tube according to claim 19, wherein said oxide of a rare earth metal is barium scandate and said oxide of an alkaline earth metal is $(Ba.Sr.Ca)CO_3$.

* * * * *